United States Patent [19]

Kollsman

[11] 3,999,224

[45] Dec. 28, 1976

[54] SHARP-EDGED SURFACE CONTOURS FOR RENDERING WATER BEARING SURFACES WET-SLIP RESISTANT

[76] Inventor: Paul Kollsman, 1010 Fifth Ave., New York, N.Y. 10028

[22] Filed: Dec. 8, 1975

[21] Appl. No.: 638,292

[52] U.S. Cl. ..... 4/185 R; 4/146; 4/173 R; 4/185 F

[51] Int. Cl.[2] ..... A47K 3/12

[58] Field of Search ..... 4/185 R, 185 F, 145, 4/173, 146, 148

[56] References Cited

UNITED STATES PATENTS

| | | | |
|---|---|---|---|
| 2,292,368 | 8/1942 | Gordon | 4/146 |
| 2,449,323 | 9/1948 | Richterkessing | 4/146 |
| 2,477,960 | 8/1949 | Caldwell | 4/185 F |
| 2,757,385 | 8/1956 | Whittick | 4/146 |
| 2,809,380 | 10/1957 | Gruan | 4/146 |
| 3,124,811 | 3/1964 | Treacy | 4/173 |
| 3,318,742 | 5/1967 | Whiteside | 4/146 X |
| 3,363,267 | 1/1968 | Kaiser et al. | 4/146 |
| 3,942,199 | 3/1946 | Kollsman | 4/185 R |

*Primary Examiner*—Henry K. Artis
*Attorney, Agent, or Firm*—Howard G. Russell

[57] ABSTRACT

The surface of a bathing fixture or a water sports device can be made wet-slip resistant by providing on the surface spaced, raised, flat topped, sharp-edged contour elements of polymeric material. These are normally uncomfortable to stand or sit on by reason of the sharp edges bearing against bare skin. Comfort is provided by automatic and selective dulling of those edges on which body weight is placed. This is accomplished by the use of polymeric material within a certain Shore Durometer hardness range which is predeterminable as a function of a thickness range of the elements between 0.1 and 1.5 mm.

13 Claims, 13 Drawing Figures

SHARP-EDGED SURFACE CONTOURS FOR RENDERING WATER BEARING SURFACES WET-SLIP RESISTANT

Smooth surfaces of bathing fixtures, for example bathtubs and shower receptors, or of water sports devices, such as surf boards, diving boards, or boat decks become slippery when wet and particularly so in the presence of water mixed with soap solution, bath oils, lotions and the like.

It has been proposed to render the surface of a bathtub wet slip resistant by a procedure according to which relatively deep parallel grooves are molded into a raised portion of the bathtub bottom, resulting in the formation of raised parallel, flat topped, but sharp-edged ribs or ridges covering that portion of the tub on which a person normally stands. The contoured surface offers wet slip resistance, but is concedely uncomfortable for a sitting bather. For this reason, according to the known proposal, the end portion of the bathtub on which a person normally sits is left smooth and flat, and therefore remains slippery.

The object of the present invention is to provide a sharp edged, flat-topped contour of a high degree of wet-slip resistance which is also comfortable for a person of sensitive skin.

My copending patent application Ser. No. 395,576 ciled Sept. 10, 1973, now U.S. Pat. No. 3,942,199 discloses and claims a sharp edged anti-wet-slip contour comprising elevated flat topped sharp edged surface elements spaced by relatively depressed portions, or grooves, of a certain dimensional range which operates in such a manner that during a first phase of contact with the skin of a portion of the human body substantially all of the initially applied relatively low, body weight acts on the elements and the spaces therebetween, hence bears against the sharp edges, thereby removing, even by a slight relative movement between skin and edge, the lubricating liquid film between element surface and skin. Immediately thereafter, as the applied body weight increases towards the full weight, the skin flexes into the grooves during a second phase and contacts the groove bottoms which then operate to support a portion of the applied body weight, thus relieving the force acting on the sharp edges. As a result, the sensation of discomfort of the sharp edges, i.e., the sensation of sharp edges digging into the skin, is reduced and a sensation of comfort results.

The present invention achieves comfort in a different manner and is based on the discovery that comfort can be provided by automatic dulling of certain load bearing edges, such dulling being in proportion to the specific load applied locally, while leaving the edges of all other non-load bearing contour elements sharp and unchanged, so that in the event of sliding or slipping the sharp edges arrest such motion by their liquid film reducing action. Once the motion is arrested, the non-load bearing edges are dulled, but any edges from which load was removed return to their original sharpness.

The ability of the edges to dull selectively and to the required degree for comfort can be defined in terms of the thickness of the elements and of the hardness of the polymeric material of the contour elements.

An industrially accepted instrument for determining hardness is the Short Durometer employing scales B and A for hard and less hard materials, respectively.

The present invention employs A scale readings. The durometer comprises basically a spring loaded plunger having a circular base area of 1/32 inch diameter. The plunger is displaceable against the action of a spring causing the base to exert a load of 822 grams on any surface on which it is placed. The maximum plunger stroke is one-hundred thousands of an inch and is produced by placing the plunger on a glass or steel surface. The plunger stroke is measured by a dial indicator reading 100 for the full stroke, 98 for a stroke of ninety-eight thousands of an inch, corresponding, accordingly, to a high degree of hardness, 90 for a stroke of ninety thousands of an inch for material of lesser hardness compressed by the plunger force by ten thousands of an inch, and so forth. These readings represent absolute or regular durometer readings and are normally based on the use of a test sample of the material of ¼-inch thickness.

For the practice of the present invention it is convenient to utilize readings taken on the top surface of the contour elements without regard to the thickness of the material under test. Such readings will for convenience hereinafter referred to as "apparent" durometer readings as the height of the contour elements may vary between 0.1 and 1.5 mm.

The polymeric material may also consist of bonded layers of different hardness for producing elements having a relatively soft top layer with dullable edges and a harder bottom layer preventing deformation of the elements and excessive stress on their bonds to the bathing fixture surface by the weight-force exerted on the elements by the bather.

A bathing fixture, more particularly a bathtub or shower receptor, or a water sports device such as a surf board or diving board comprising on its surface a plurality of elevated solid elements composed of polymeric material, said elements being contoured to have a flat top surface and side surfaces meeting the respective top surface along relatively sharp edges, said top surface and edges being free from substantial elevational irregularities, adjacent elements being spaced by relatively depressed portions, the height of said elements relatively to said depressed portions being not less than 0.1 and not more than 1.5 mm., the mean width of said depressed portions, taken individually, being not less than said height is rendered wet slip resistant, and comfortable, according to the present invention by the use of polymeric material of a certain hereinafter specified Short Durometer Scale A apparent hardness, the apparent hardness range for a height of 1.5 mm. being between an upper limit of 94 units and a lower limit of 52 units, the upper limit increasing by two units to a maximum of 99 and the lower limit increasing by 8 units to a maximum of 96 units for each incremental reduction in height by a 0.25 mm. from 1.5 mm., the upper limit being 99 and the lower limit being 96 for a height of 0.1 mm., whereby an initial high degree of edge sharpness at no load is automatically reduced progressively with increasing body weight placed on the respective edge, thus reducing discomfort by a local reduction of the sensation of edge sharpness, while maintaining the initial high degree of edge sharpness for all load-free edge portions.

The objects features and advantages of this invention will appear more fully from the detailed description which follows accompanied by a graph and drawings showing, for the purpose of illustration preferred embodiments of the invention. The invention also resides in certain new and original features of construction and arrangement of structural elements.

Although the characteristic features of the invention, which are believed to be novel, will be particularly pointed out in the claims appended hereto, the invention itself, its objects and advantages and preferred manners in which it may be carried out may be better understood by referring to the following description taken in connection with the accompanying drawings forming a part of the disclosure.

Figure 4:
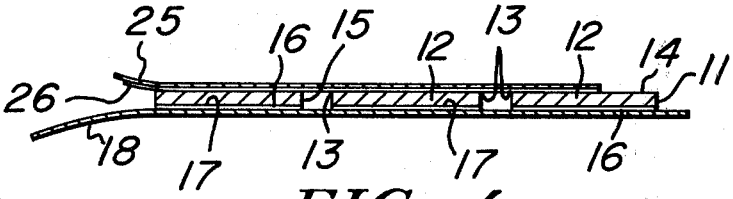
Figure 5:
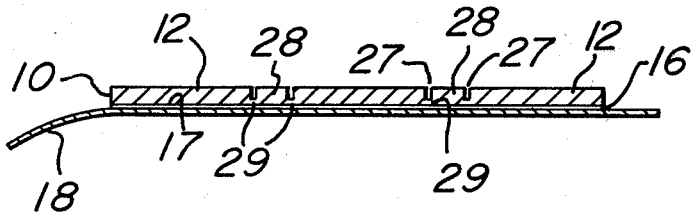
Figure 6:
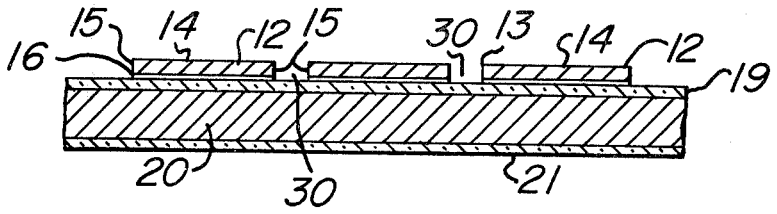
Figure 7:
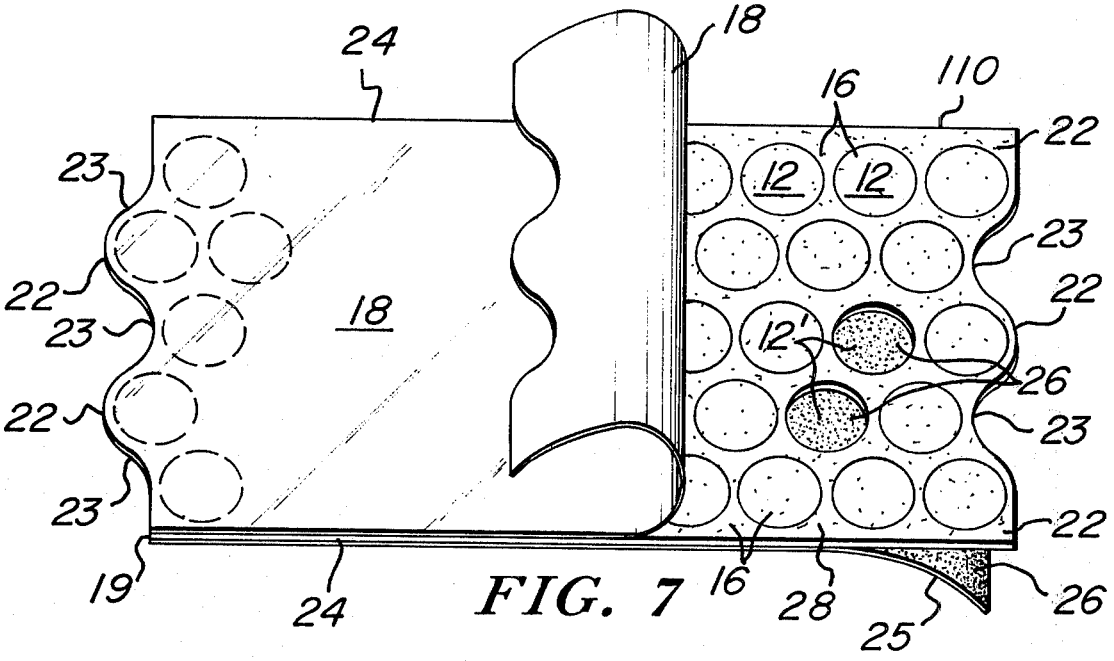
Figure 12:
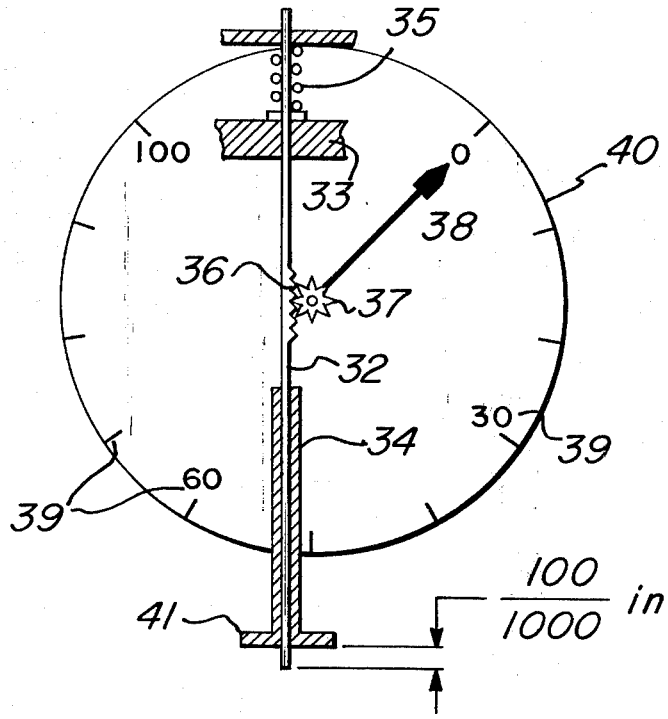
Figure 13:
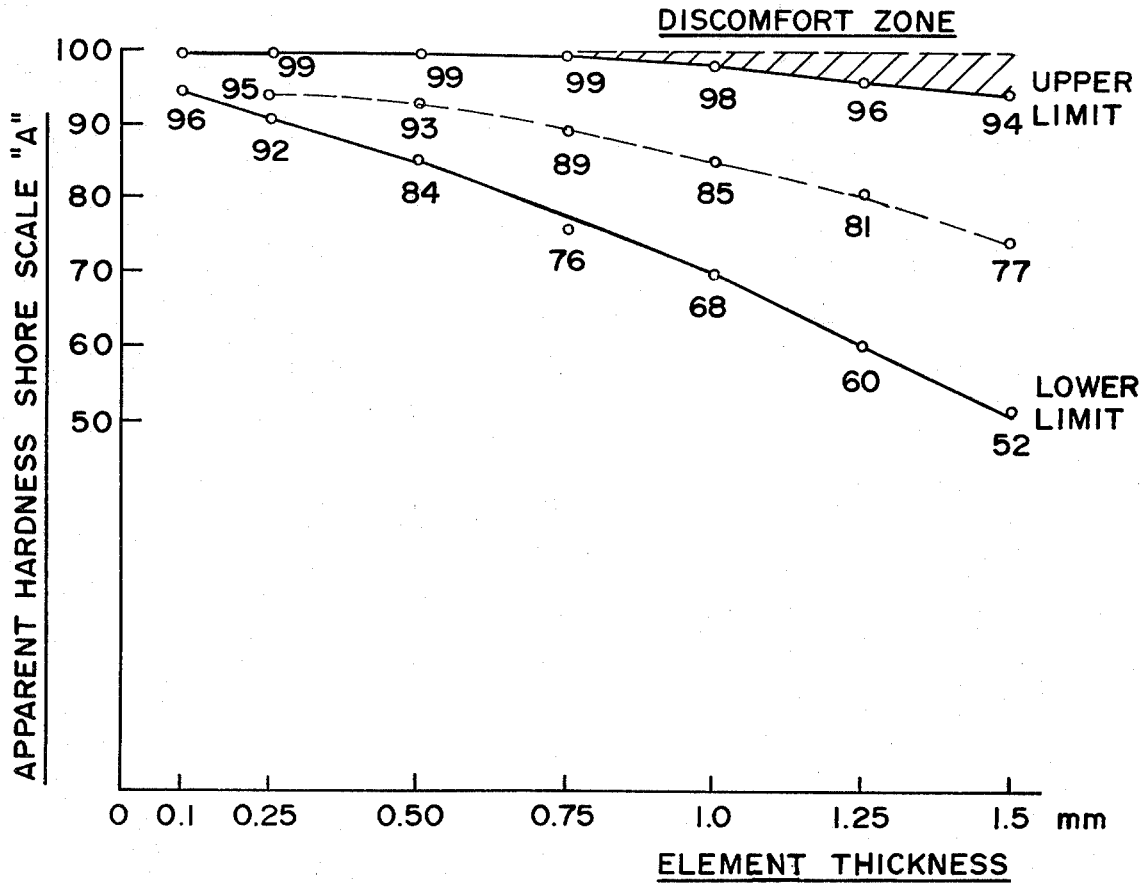

FIGS. 4, 5, and 6 are sectional elevations of modified forms of appliques;

FIG. 7 is a perspective view of an applique for the joint installation of a group of elements;

FIGS. 8 to 11 are plan views of still other forms of appliques;

FIG. 12 is a schematic illustration of a durometer for hardness measurement; and FIG. 13 is a graph giving the hardness ranges of polymeric material as a function of element height or thickness and outlining conditions of comfort and discomfort.

In the following description and in the claims various details will be identified by specific names for convenience. The names, however, are intended to be generic in their application. Corresponding reference characters refer to corresponding parts in the several figures of the drawings.

The drawings accompanying, and forming part of, this specification disclose certain specific details of construction and arrangement for the purpose of explanation of broader aspects of the invention, but it should be understood that structural details may be modified in various respects without departure from the principles of the invention and that the invention may be incorporated in other structural forms than illustrated.

With respect to the term "sharp" and "sharpness" it was found that a molded edge having a radius of the order of one tenth of a millimeter is sufficiently sharp for the purpose of practicing this invention. However radii of the order of one half of a millimeter produce a satisfactory degree of slip proofing satisfying the requirements of this invention.

The term "flexible" relates to the ability of sheet material to conform to curvatures present in ordinary bathing fixtures, but does not imply compressability.

The term "rigid" relates to resistence of the material to resist gross deformation of the elements under forces encountered in normal use, i.e., the ability to maintain the surface contours undistorted, except for minor temporary edge dulling under applied body weight, the natural elasticity of rigid material insuring return to original sharpness after removal of the body weight load.

The term "contact adhesive" means an adhesive capable of adhering to, and effecting a bond with, another surface, such as a vitreous bathing fixture surface, a boat deck, or a surf board, by mere contact of its highly tacky surface after removal therefrom of a protective sheet which is readily peelable from the adhesive by reason of the composition, or treatment, of the protective sheet.

The term "bonded" means adhered firmly with, or without, a bonding agent and includes adhering in the nature of welding or fusing together.

Materials suitable for the practice of the invention are flexible, semi-flexible or rigid polymeric materials, such as polyvinyl chloride, polycarbonate, polyester, polyurethane, as well as natural and synthetic elastomeric materials. All these materials are available in the trade in the form of sheet material. Sheet material in the thicknesses employed by the invention as anti-slip appliques is sufficiently flexible to adapt itself to the curvatures of the surface of bathing fixtures, surf board or boat decks etc.

The invention, however, is not limited to the use of appliques, but the sharp edged anti-slip contours may be molded into the top layer of the article for slip proofing, for example into the bottom, or rim, of a molded, essentially non metallic, bathtub.

The thickness of sheet material used for appliques may vary from between four thousands of an inch (0.25 mm.) to over 60 thousands of an inch (1.5 mm.).

Bonding materials for attaching non-slip appliques to surfaces to be slip proofed may be time-setting, heat-setting or otherwise curing adhesives applied to the fixture surface, or the applique, or to both. Contact adhesives applied to the bottom surface of the applique have been found particularly suited. Many contact adhesive compositions, including heat resistent compositions, are commercially available.

Figure 1:
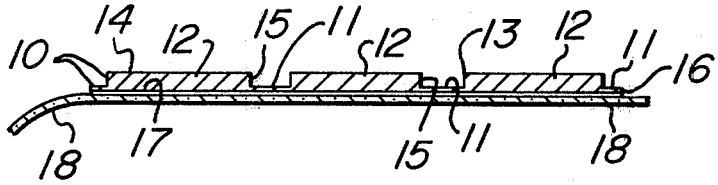
FIG. 1 is a sectional side elevation of a portion of an anti-slip applique, three elements being shown.

Referring to the drawings, the anti-wet-slip applique shown in FIG. 1 may be formed from an originally flat sheet 10 of polymeric material by molding under heat and pressure of the sheet to produce thereon individual raised contour elements 12. The elements 12 of the form of applique shown in FIG. 1 are interconnected with one another along integral relatively depressed portions 11 of the sheet which may also be considered grooves between adjacent raised portions 12. Thus the raised portions 12 and the depressed portions are integral portions of one surface-contoured sheet 10.

As shall be later explained, the polymeric structure of the applique may also be formed of a relatively thin base sheet of the thickness of the depressed portions of 11 to which elements 12 are attached in a suitable manner, for example by heat bonding. If so formed, the material of the continuous flat base sheet may be chosen to have a hardness different from the hardness of elements 12 bonded thereto.

The depressed portions or grooves may range in mean width between 0.75 and 4 mm., and a depth of between 0.1 and 1.5 mm..

The top surfaces of the contour elements 12 are flat and smooth and are bounded by a sharp edge 13, the edge being the line along which the lateral surface 15 and the top surface 14 meet.

Hydrophobic properties of normally glossy molded top surfaces 14 may be reduced by slight abrading of the surface to produce more even or uniform wetting of the surface. Demonstrably this measure enhances the basic anti-slip properties of the contoured surface. The physical reasons why such abrading leads to enhanced anti-slip properties has not yet been determined, but it appears that an increase in dry friction is not involved, as in certain instances the abrading operation removes rather than creates surface irregularities of the molded structure.

The bottom surface 17 of the applique is flat and has a layer 16 of bonding material, for example contact adhesive, applied to it, contact adhesive 16 being normally protected by a protective sheet 18 of paper or plastic material until the protective sheet is removed prior to installation of the applique.

The elements 12 shown in FIG. 1 may be discs, ellipses, squares, hexagons, triangles, or straight, zig-zag or undulating elongated strips or other shapes, the principal structural feature being the edges 13 which, when encountered by skin moving slightly to the left or to the right, in the drawing act to remove from the skin, or reduce to extreme thinness, the slip-promoting liquid film of soap-water, bath oil, lotion, etc., acting as a lubricant.

The edge 13 should be free from substantial elevational irregularities such as would be present, if the surface 14 were not flat, but had plastic granules bonded thereto or pillow shaped convex topped elevations formed thereon, as are present in certain prior art appliques.

Substantial elevational irregularities are deemed to be such as would permit lubricating liquid to be carried past the edge through gaps therein which then acts as a lubricant between skin and the top surface of the applique.

By way of contrast, very slight elevational differences of the orderof a few thousands of an inch, as are occasionally provided in plastic sheets for ornamental purposes, particularly for creating a pattern of reflected light, or patterns of depressions of minute depth, are not considered substantial elevational irregularities for the purpose of definition. The last mentioned minor irregularities do not defeat the liquid film reducing action of the sharp edge.

Figure 2:
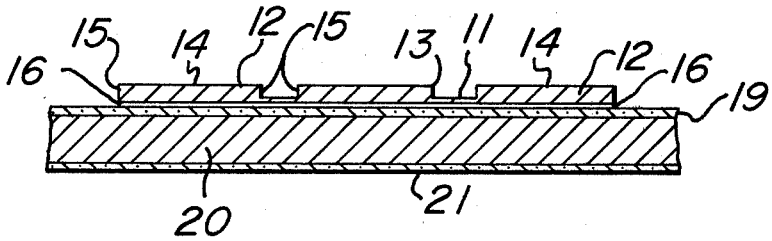
FIG. 2 shows the applique portion of FIG. 1 on a vitreous-coated fixture surface.

FIG. 2 shows the applique portion of FIG. 1 bonded to the vitreous top layer 19 of a bathtub whose iron body 20 carries a further vitreous layer 21 on its underside.

Figure 3:
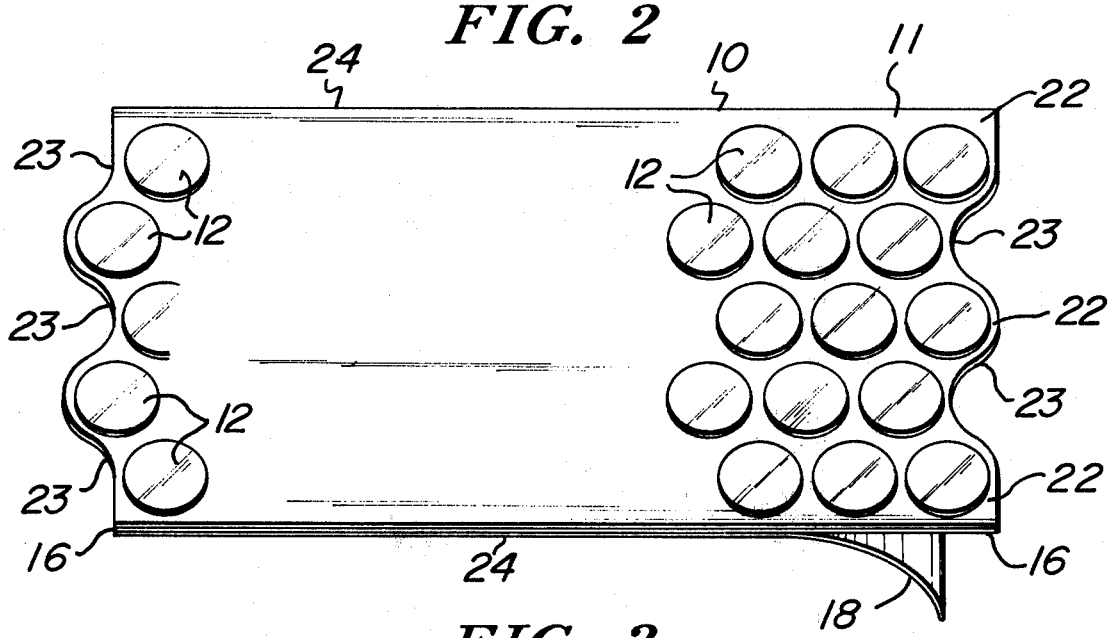
FIG. 3 is a perspective view of an applique containing a plurality of individual elements.

The applique shown in FIG. 3 contains about 70 contour elements within an area of about 9½ by 3¼ inches (240 by 80 mm). The ends of the applique may be contoured to permit abutting appliques to mesh end to end. Projecting portions 22 at one end of the applique match recessed portions 23 at the opposite end. The sides 23, 24 are parallel and aid in installing appliques side-by-side.

In a typical bathtub installation five parallel rows of four appliques provide a pattern of about 1400 sharp edged slip-preventing disc-shaped elements.

It is obvious that, instead of integrally molding the contoured sheet 11, 12, the sheet may be prefabricated by bonding or fusing contour elements 12 to a common membrane of the thickness of the portions 11. In such a case the elements 12 may also be of a color contrasting with the color of portions 11.

FIGS. 4 to 7 illustrate an applique structure for installation of individual sharp-edged contour elements jointly, as a group, on a surface to be wet-slip proofed.

Referring to FIG. 4, the individual contour elements may be produced by form cutting, in the sense of severing sheet material by the cutting action of a knife or a die. Tools for this purpose are known per se and are in wide use in the sheet metal, paper board, and paper industries.

Characteristic of such form cutting is the generation of sharp edges, such as at 13. A layer of contact adhesive is applied to the bottom surface of the contour element 12 and a protective sheet 18 of paper or plastic material covers the layer 16, the sheet 18 being readily peelable from the adhesive prior to installation.

The contour elements 12 of FIG. 4 may be separate strips or islands and are pre-arranged as a group in a certain geometric pattern which they are to assume on the fixture surface after installation.

A transfer sheet 25 with a layer of adhesive 26 on its underside extends across the top surfaces 14 and is adhered thereto, thereby maintaining elements 12 in their prearranged relative position even after removal of the protective sheet 18.

An alternative manner of maintaining contour elements 12 in a relationship of predetermined spacing is illustrated in FIG. 5. Contour elements 12 are form-cut by cuts 27 which also define matrix or waste portions 28 disposed between adjacent contour elements. The cuts 27 extend entirely through the sheet and through the adhesive layer, except at spaced points 29 where the cutting knife, which performs the operation, has a small V- or U-notch ground into its cutting edge. This so called "nicking" procedure is known and used in the paperboard industry for somewhat different purposes. The V-notched knife leaves weak interconnecting bridges as shown at 29 between the elements 12 and the matrix portion 28. After installation of the applique 12, 28 the matrix portion 28 is removable from between the elements 12, by tearing of the weak bridges.

The forming of the contour elements by knife-cutting inherently produces particularly sharp edges 13, which is highly desirable. Due to the entry of knives into the material at 27 a certain degree of crowding, particularly of the matrix or waste material 28 occurs which is minimized by making the distance between adjacent contour elements equal to at least double the height or thickness of the contour elements. Such spacing permits the skin to flex considerably into the depressed portions which is advantageous as it promotes mechanical interlocking of the flexed skin with the contoured surface. However, the weight pressure on the edges 13 makes the edges more noticeable to the touch than if the spacing were narrower. This is remedied by the automatic edge dulling under load which minimizes a sense of discomfort by edges digging into the skin.

The layer of adhesive 16 serves to bond the sheet to the fixture surface. The adhesive bond of the elements 12 is stronger than the bridge connections 29 between the elements 12 and the matrix portions, and relatively little force is required for pulling out strips of matrix material from between the elements which thus remain undisturbed by the matrix removal.

FIG. 6 shows, in cross-section, several elements 12 bonded to the vitreous top layer 19 of a bathtub whose iron body 20 carries a further vitreous layer 21 on its underside. The matrix portions were removed leaving grooves or depressed portions 30 between adjacent elements.

FIG. 7 is an isometric bottom view of a preferred form of applique for joint installation of a group of about seventy circular island elements 12, die cut from a strip 110, leaving a matrix or waste portion 28 to surround the disc-shaped elements 12. Prior to installation discs 12 and matrix 28 are held in place by a transfer sheet 25 extending across elements 12 and matrix 28 and carrying a coating of adhesive 26. A protective bottom sheet 18 protects the contact adhesive 16 on the bottom surface of the entire strip 110 and is removable prior to installation of the strip.

The applique is then applied in its proper location, for example, by aligning one of its lateral edges 24 with a center line drawn in the bathtub, while the applique is being held at an upward slant, so that the other lateral edge is elevated. The applique is then laid flat on the bathtub surface and adheres to it, aided perhaps by slight pressure to flatten out any spaces between surface and adhesive.

After adhesion the transfer sheet 25 is first removed, and finally the matrix portion 28 is pulled out from between the elements 12.

A pre-form-cut sheet 110 as shown in FIG. 7 may also be used to produce the applique of FIG. 4 as follows: The matrix 22 is first removed from between the elements 12 attached to the protective sheet 18, followed by application of the transfer sheet 25, 26 to the tops of the then physically spaced elements. The resulting applique structure is shown in FIG. 4 and is installable by first removing the protective sheet 18, adhering the elements 12 to the fixture surface, and finally removing the transfer sheet 25.

In FIG. 7 the applique strip 110 is shown inverted and two discs are shown removed to render the adhesive 26 on the transfer sheet 25 visible through the resulting apertures 12'.

Figure 8:
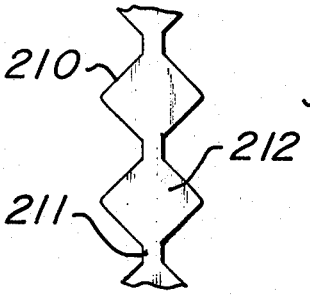

The applique strip 210 shown in FIG. 8 comprises basically diamond-shaped elements 212 interconnected by a central stem 211 to form a continuous strip. The points of the diamonds are slightly rounded, so as to permit the strips to be cut from a large sheet or roll without waste by arranging the laterally projecting points of one strip to nest in the receding neck portions at the stems of the two adjacent strips.

Figure 9:
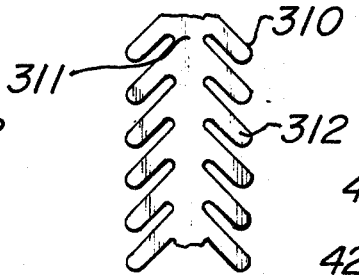

The applique 310 of FIG. 9 may be considered as being composed of stacked chevrons 312 interconnected along a central stem 311.

Figure 10:
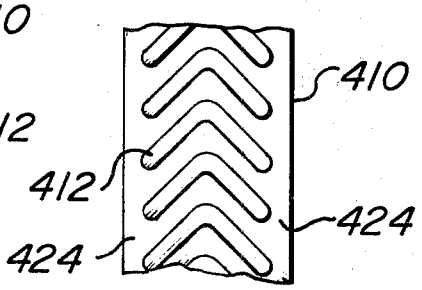

In the applique of FIG. 10 individual chevrons 412 are arranged on a common parallel-sided relatively thin base strip 410 leaving a narrow thin marginal portion 424 along opposite edges which cling tenaceously to an undersurface to which the applique is attached by adhesive and resists detachment therefrom as the edge presents little exposure to lateral forces of a bathers feet tending to dislodge the applique.

Figure 11:
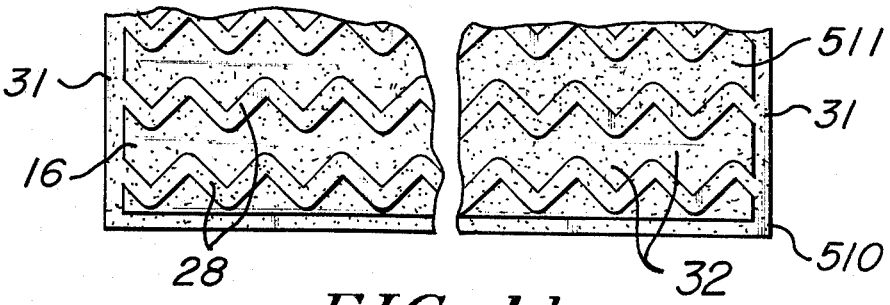

The applique 510 of FIG. 11 comprises zig-zag shaped element strips 16 form-cut from a rectangular sheet producing waste matrix material 28 interconnected at opposite ends by strips 31. After installation of the entire applique 16, 28, 31 the matrix portion 31, 28 may be pulled out from between the element strips 16 which then remain attached to the surface to be slip-proofed.

Element strips of the shape shown in FIG. 11 may also be produced and installed by a method not employing matrix or waste material. The central portion 511 of the strip of FIG. 11 represents a central or stem portion from which laterally extend projecting portions similar to those of FIG. 8 except that projections extending to one side alternate with projections extending to the opposite side.

The effectiveness of contoured anti-wet-slip surfaces is measurable by appropriate measuring devices. A representative device disclosed in my copending application Ser. No. 395,576, now U.S. Pat. No. 3,942,199 dated Mar. 9, 1976 comprises a carriage on which the anti-slip surface under test is mounted. A predetermined weight pull the carriage in a horizontal direction upon release of a brake. A resilient test pad having surface properties comparable to human skin and weighted by a predetermined weight is lowered onto the wetted test surface very briefly after release of the carriage brake, and the total distance of carriage travel is measured to the point at which the carriage is arrested by the pad. Manifestly the shorter the travel, the more effective the anti-slip surface under test.

The degree of comfort or discomfort of an anti-slip surface portion applique is measured independently to determine whether the anti-slip surface portion or applique feels comfortable. In this test, naturally, a completely smooth surface rates highest in comfort, but lowest in anti-slip rating. On the other hand, a slip-proofed surface comprising a contour of sharp-edged elements, which by reason of their physical arrangement or unchanging sharpness of the edges dig into the skin or cut the skin under the body weight may rank high in anti-slip properties, but low on the comfort scale.

Comfort may be increased according to this invention by permitting sharp edges automatically and temporarily to dull under the body weight. This property is measurable in terms of material hardness and material thickness.

A basis of this invention is the discovery that within certain limits of groove depth, or element thickness, and hardness, high degrees of comfort and wet-slip resistence can be achieved, and are predeterminable, without resort to experimentation for every change or choice in thickness, dimension, or hardness.

Wet-slip resistance test: (Pad load 25 lb.)

| | Dry | Wet |
|---|---|---|
| smooth surface | 8 lb; 1.5 in. | 1.5 lb; over 5 in. |
| granular neoprene surface (prior art) | 8 lb; 0.25 in. | 6 lb; over 5 in. |
| contour FIG. 3 ⅝ discs spaced 18 mm center to center. vinyl | 8 lb; 4 in. | 8 lb; 0.5 in.<br>15 lb; 3 in. |
| contour FIG. 3 slightly abraded | 8 lb; 2.5 in. | 8 lb; 0.4 in.<br>18 lb; 3 in. |

Wet-slip resistance vs. hardness.

Zig-zag elements of 4 mm width spaced by grooves of 2 mm width and 1 mm depth. Pad load 25 lb.

| Apparent hardness | | Dry | Wet |
|---|---|---|---|
| 100 | (acrylic) | 8 lb; 0.3 in. | 20 lb; 3 in. |
| 99 | (vinyl) | 8 lb; 0.33 in. | 19.5 lb; 3 in. |
| 98 | (vinyl) | 8 lb; 0.36 in. | 17.8 lb; 3 in. |
| 94 | (vinyl) | 8 lb; 0.40 in. | 16.6 lb; 3 in. |
| 92 | (vinyl) | 8 lb; 0.44 in. | 15.2 lb; 3 in. |
| 85 | (vinyl) | 8 lb; 0.5 in. | 14.1 lb; 3 in. |

Comfort test vs. hardness and groove depth

Test plates were prepared having parallel grooves spaced 15 mm apart, the width of the grooves being double the respective depth dimension.

| groove depth (mm) | apparent hardness and comfort | | |
|---|---|---|---|
| 0.1 | 100<br>very comfortable | 99<br>very comfortable | 97<br>very comfortable |
| 0.25 | 100<br>comfortable | 99<br>comfortable | 96<br>very comfortable |
| 0.5 | 100<br>tolerable | 99<br>comfortable | 93<br>very comfortable |
| 0.75 | 100<br>tolerable | 99<br>comfortable | 89<br>very comfortable |
| 1.0 | 99<br>rough | 98<br>tolerable | 85<br>very comfortable |
| 1.25 | 96<br>rough | 95<br>tolerable | 81<br>comfortable |
| 1.5 | 93<br>rough | 92<br>tolerable | 71<br>comfortable |

-continued

| | | | |
|---|---|---|---|
| 1.75 | 90 rough | 89 uncomfortable | 72 uncomfortable |
| 1.75 | "90 rough | "89 uncomfortable | 68 uncomfortable |

Comments: The dry/wet slip resistance tests show that in testing a smooth surface the carriage displacement is 1.5 in. in dry condition, and over 5 in. in wet condition (off-the-scale of the device).

A typical prior art surface produces high dry slip resistance of only 0.25 displacement, but uncontrollable sliding in wet condition, even under a reduced pull of only 6 lb.

By contrast, the contour of FIG. 3 permits 4 in. travel of the carriage in dry condition, but only 0.5 in. travel in wet condition. An additional test shows that under a greatly increased pull of 15 lb. the travel is only 3 in., which is less than in dry condition under a lesser pull of only 8 lb.

Slight abrasion of the surfaces produces a measurable improvement over a non abraded nearly glossy molded surface, presumably because of the more even wetting of the surface whose essentially hydrophobic character was rendered somewhat hydrophilic by abrasion.

The wet slip resistance vs hardness test shows a relatively slight reduction in total wet slip resistance, due to automatic edge dulling under load for increasingly softer materials. An apparent hardness of 85 of the material results in a carriage travel of only 3 in. under 14.1 lb. pull, as against an optimum condition of 20 lb. pull for material of maximum hardness of 100 in which the Short durometer registers zero compressibility.

The comfort test was conducted by placing body weight on one heel and turning and twisting the heel across the grooves and its bordering sharp edges. The test establishes that comfort decreases with an increase in groove depth (or height of the contour elements), but that it may be increased by use of a material of lesser hardness.

Thus, in an applique in which the material thickness is 0.3 mm at the bottom of the grooves, and in which the top surface of the elements is at a level 1.2 mm above the groove bottom, a total of 1.5 mm of material is subject to compression when the durometer plunger is placed on the top surface adjacent the sharp edge.

From the graph of FIG. 11 a convenient optimum condition can be extrapolated characterized by a higher degree of comfort than provided by the hardness maximum and a higher degree of wet slip resistance than afforded by the hardness minimum.

The graph of FIG. 13 may be used as follows: After selection of a contour whose elements have a predetermined height, for example 1.2 mm, the graph indicates that the material should have an "apparent" hardness of less than 96 and more than 60 durometer units.

A choice of a material of a hardness of about 77 insures comfort and good wet slip resistance for a material thickness of 1.5 mm, it being further apparent that for the chosen element height or thickness a hardness of 94 or greater is bound to be uncomfortable. Conversely, if material of a certain hardness, say 89, is available, the graph indicates that an element height of 0.75 gives optimum wet slip resistance and comfort.

In this manner a positive rule is established by the invention and trial and error are eliminated.

Further, assuming contoured surfaces of different material hardness are available, it is readily predictable from a simple durometer test whether the respective contoured surface meets established safety and comfort requirements.

FIG. 12 shows the basic durometer mechanism. The plunger 32 slidable in bearings 33, 34 is under the action of a spring 35. The plunger carries a rack 36 meshing with a pinion 37 operating a pointer 38 readable against indicia 39 on a dial 40.

In one end position the plunger protrudes one-hundred thousands of an inch, from a base plate 41 corresponding to a reading of zero. When fully depressed, or rather lifted against the action of the spring, the plunger protrusion from the base plate 41 becomes zero, corresponding to a reading of 100, indicating a degree of hardness permitting no indentation to be produced by the plunger pressed thereagainst.

The anti-wet-slip surface improved according to this invention operates as follows, using a bathtub surface as an example:

Height of elements vs hardness (max) for comfort and hardness (min) for anti-slip action.

| height of elements (mm) | increment | Apparent hardness measured between top and bottom surface i.e. thickness: minimum | increment | Maximum | increment |
|---|---|---|---|---|---|
| 0.1 | | 96 | | 100 | |
| 0.25 | | 92 | | 99 | |
| | 0.25 | | 8 | | 0 |
| 0.50 | | 84 | | 99 | |
| | 0.25 | | 8 | | 0 |
| 0.75 | | 76 | | 99 | |
| | 0.25 | | 8 | | 1 |
| 1.0 | | 68 | | 98 | |
| | 0.25 | | 8 | | 2 |
| 1.25 | | 60 | | 96 | |
| | 0.25 | | 8 | | 2 |
| 1.5 | | 52 | | 94 | |

The graph of FIG. 13 shows the upper and lower "apparent" hardness data plotted against height of the elements.

It should be noted in this connection that the depth of the grooves is normally slightly less than the total thickness of the contour elements subjected to compression in appliques of the kind shown in FIGS. 1 and 3.

Initially, all contour edges are at their maximum sharpness. A bather stepping onto the wet contoured surface places a portion of his body weight on the surface with a certain horizontal force component. Assuming the body weight portion on one foot is 70 lb., and the horizontal force component is 15 lb., it is the horizontal component which promotes sliding and slipping.

In the event the bather's foot slips slightly on the contoured surface such sliding motion is arrested by the liquid film removing action of the sharp edges within usually less than one inch of travel. It is only then that the full body weight portion begins to bear down on the contoured area portion covered by the bather's foot. The body weight then causes a certain degree of dulling of the edges within that area portion. Beyond that area portion the edges remain sharp and are fully active, should sliding of the foot occur. If the bather changes his foot position, the edges within the zone from which weight was removed resume full sharpness and the ones now under weight load dull to a certain degree.

If the bather sits down, dulling of the edges occurs in the same manner, but to a lesser degree, as the relative weight force per surface area unit is less than within an area under foot. A lesser degree of dulling in case of a sitting bather is tolerable as a feeling of discomfort is also less due to the smaller weight force acting against the edges within each area unit.

What is claimed is:

1. A bathing fixture, more particularly a bathtub or shower receptor, or a water sports device such as a surf board or diving board comprising on its surface a plurality of elevated solid elements composed of polymeric material, said elements being contoured to have a flat top surface and side surfaces meeting the respective top surface along relatively sharp edges, said top surface and edges being free from substantial elevational irregularities, adjacent elements being spaced by relatively depressed portions, the height of said elements relatively to said depressed portions being not less than 0.1 and not more than 1.5 mm, the mean width of said depressed portions, taken individually, being not less than said height, said polymeric material being of a certain hereinafter specified Shore Durometer Scale A "apparent" hardness, the apparent hardness range for a height of 1.5 mm being between an upper limit of 94 units and a lower limit of 52 units, the upper limit increasing by two units to a maximum of 99 and the lower limit increasing by 8 units to a maximum of 96 units for each incremental reduction in height by 0.25 mm from 1.5 mm, the upper limit being 99 and the lower limit being 96 for a height of 0.1 mm, whereby an initial high degree of edge sharpness at no load is automatically reduced progressively with increasing body weight placed on the respective edge, thus reducing discomfort by a local reduction of the sensation of edge sharpness, while maintaining the initial high degree of edge sharpness for all load-free edge/portions.

2. A bathing fixture as defined in claim 1 in which the top surface of said elements is slightly abraded.

3. An applique for rendering wet-slip resistant a wettable surface, such as of a bathing fixture or a water sports device by attachment thereto of a plurality of raised contour elements disposed in a predetermined pattern group, said applique comprising a plurality of spaced contour elements of polymeric sheet material, said elements being disposed in a predetermined pattern of relative spacing to constitute said pattern group, said elements comprising, individually, a flat top surface, a bottom surface, and lateral surfaces, said lateral surfaces extending from said top surface to said bottom surface and meeting the respective top surface along a sharp edge, which edge is free from substantial elevational irregularities; a layer of contact adhesive on the bottom surfaces of the elements of said group for bonding the elements of said group jointly to a fixture surface; a continuous protective sheet overlying the layer of adhesive of said group and being releasable therefrom; and means separate and apart from said protective sheet for inter-connecting said elements to maintain the entire group of elements in its pattern during removal of said protective sheet, and transfer and application of the elements to the fixture surface, said contour elements being of a thickness not less than 0.1 and not more than 1.5 mm., the mean spacing of the elements constituting an individual pair being not less than said thickness, said polymeric material being of a certain hereinafter specified Short Durometer Scale A "apparent" hardness, the apparent hardness range for a height of 1.5 mm being between an upper limit of 94 units and a lower limit of 52 units, the upper limit increasing by two units to a maximum of 99 and the lower limit increasing by 8 units to a maximum of 96 units for each incremental reduction in height by 0.25 mm from 1.5 mm, the upper limit being 99 and the lower limit being 96 for a height of 0.1 mm, whereby an initial high degree of edge sharpness at no load is automatically reduced progressively with increasing body weight placed on the respective edge, thus reducing discomfort by a local reduction of the sensation of edge sharpness, while maintaining the initial high degree of edge sharpness for all load-free edge/portions.

4. An applique as defined in claim 3 in which the top surface of said elements is slightly abraded.

5. An anti-wet-slip applique as defined in claim 3 in which said means comprises a continuous transfer sheet having a layer of adhesive on its under-surface, said layer being releasably affixed to the top surfaces of the elements of the entire group, the strength of adhesion of said transfer sheet with respect to the elements being superior to the strength of adhesion of said protective sheet with respect to said layer of contact adhesive.

6. An anti-wet-slip applique as defined in claim 3 in which said elements are form-cut and in which said means comprises a continuous transfer sheet having a layer of adhesive on its under-surface, said layer being releasably affixed to the top surfaces of the elements of the entire group, the strength of adhesion of said transfer sheet with respect to the elements being superior to the strength of adhesion of said protective sheet with respect to said layer of contact adhesive.

7. An anti-wet-slip applique as defined in claim 3 in which said means comprise a continuous matrix disposed between the spaced elements of the group, and a continuous transfer sheet having a layer of adhesive on its undersurface, said layer being releasably affixed to the top surfaces of all the elements of said group and to the top surface of the matrix disposed between the said elements of said group.

8. An anti-wet-slip applique as defined in claim 3 in which the said means comprise a continuous matrix disposed between spaced elements, and rupturable bridges extending from points of the lateral surface of said elements to the respective lateral surfaces of the respective adjacent matrix, and from the latter to the respective adjacent elements, respectively, the strength of said bridges being superior to the strength of adhesion of the said protective sheet with respect to said layer of contact adhesive.

9. An anti-wet-slip applique as defined in claim 3 in which said means comprises an elongated continuous stem portion from which laterally extend element portions so disposed and shaped that the bounding edges of said element portions form a geometric pattern of successively increasing and decreasing distance from the stem portion.

10. An anti-wet-slip applique for attachment to the wettable surface of a bathing fixture or a water sports device, the applique comprising a body sheet of flexible polymeric sheet material, the sheet having a flat bottom surface for bonding of the applique to said wettable surface, the upper surface of the sheet being contoured to form thereon a plurality of integral raised contour elements, said elements being solid and comprising a flat top surface and side surfaces meeting said top surface along sharp edges which are substantially free from elevational irregularities, said polymeric material being of a rigidity, and having resistance to deformation, sufficient to retain its shape under load conditions of normal use, adjacent contour elements being spaced by the relatively depressed portions of the sheet with which they are integral, the mean depth of said depressed portions relatively to the respective top surface being at least 0.1 and not more than 1.5 mm, the depressed portions being of a mean width of not less than the respective depth, said polymeric material being of a certain hereinafter specified Shore Durometer Scale A "apparent" hardness, the apparent hardness range for a height of 1.5 mm being between an upper limit of 94 units and a lower limit of 52 units, the upper limit increasing by two units to a maximum of 99 and the lower limit increasing by 8 units to a maximum of 96 units for each incremental reduction in height by 0.25 mm from 1.5 mm, the upper limit being 99 and the lower limit being 96 for a height of 0.1 mm, whereby an initial high degree of edge sharpness at no load is automatically reduced progressively with increasing body weight placed on the respective edge, thus reducing discomfort by a local reduction of the sensation of edge sharpness, while maintaining the initial high degree of edge sharpness for all load-free edge/portions.

11. An applique as defined in claim 10 in which said body sheet comprises, on at least two opposite sides, a border zone of the total thickness less than the thickness of said elements.

12. An applique as defined in claim 10 in which the top surface of said elements is slightly abraded.

13. An applique for rendering wet-slip-resistant a wettable surface, such as of a bathing fixture or a water sports device by attachment thereto of raised contours, said applique comprising contour elements of polymeric sheet material, said elements being shaped and disposed to constitute a repetitive pattern, said elements comprising a flat top surface, a bottom surface and lateral surfaces, said lateral surfaces extending to said top surface and meeting the respective top surface along a sharp edge which edge is free from substantial irregularities; a layer of contact adhesive on the bottom surface of said elements for bonding said elements to a fixture surface; a protective sheet overlying the layer of adhesive and being releasable therefrom, said elements comprising an elongated continuous stem portion from which extend, integral with said stem portion, lateral element portions so disposed and shaped that the bounding edges of said element portions form a geometric pattern of successively increasing and decreasing distance from said step portion, said contour elements being of a thickness of not less than 0.1 and not more than 1.5 mm the mean spacing of said lateral portions being not less than said thickness, said polymeric material being of a certain hereinafter specified Shore Durometer Scale A "apparent" hardness, the apparent hardness range for a height of 1.5 mm being between an upper limit of 94 units and a lower limit of 52 units, the upper limit increasing by two units to a maximum of 99 and the lower limit increasing by 8 units to a maximum of 96 units for each incremental reduction in height by 0.25 mm from 1.5 mm, the upper limit being 99 and the lower limit being 96 for a height of 0.1 mm, whereby an initial high degree of edge sharpness at no load is automatically reduced progressively with increasing body weight placed on the respective edge, thus reducing discomfort by a local reduction of the sensation of edge sharpness, while maintaining the initial high degree of edge sharpness for all load-free edge/portions.

* * * * *